United States Patent [19]

Hilshorst

[11] 4,332,422

[45] Jun. 1, 1982

[54] PAVEMENT PLANING DEVICE

[76] Inventor: Howard H. Hilshorst, c/o Hiott Corp., 2401 Bobmyer Rd., Fairfield, Ohio 45014

[21] Appl. No.: 604,601

[22] Filed: Aug. 14, 1975

[51] Int. Cl.[3] ..... E01C 23/12

[52] U.S. Cl. ..... 299/39; 299/85

[58] Field of Search ..... 299/93, 39, 36, 40, 299/85

[56] References Cited

U.S. PATENT DOCUMENTS

| | | | |
|---|---|---|---|
| 2,263,589 | 11/1941 | Osgood | 299/93 |
| 2,336,487 | 12/1943 | Lewis et al. | 299/39 |
| 2,520,229 | 8/1950 | Trauger | 299/39 |
| 2,664,281 | 12/1953 | Luksch et al. | 299/39 |
| 3,223,451 | 12/1965 | Orr | 299/39 X |

FOREIGN PATENT DOCUMENTS

| | | | |
|---|---|---|---|
| 1210450 | 3/1960 | France . | |
| 118480 | 5/1958 | U.S.S.R. | 299/39 |

*Primary Examiner*—William F. Pate, III

[57] ABSTRACT

A pavement planing device including a rotating wheel on which cutter holders are pivotally mounted. A restraining stop member mounted on the wheel restrains outward swinging of the cutter holders as the wheel is rotated. Retraction stop members mounted on the wheel are engaged by the cutter holder members as they swing backwardly following impact with the surface of the pavement. The cutter holder members rebound from the retraction stop members to cause multiple tool impacts on the surface.

2 Claims, 7 Drawing Figures

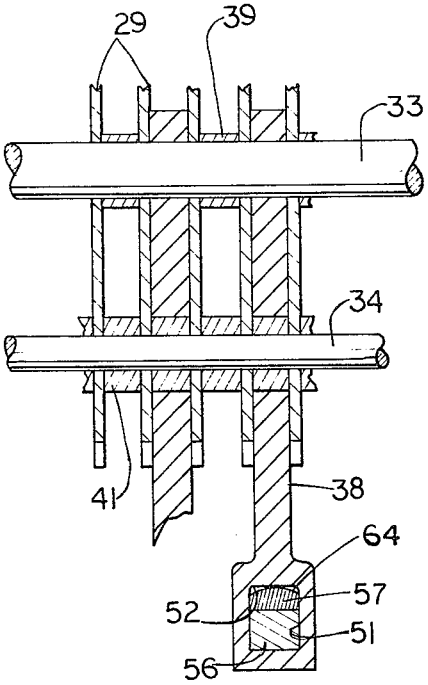
FIG. 5
FIG. 7
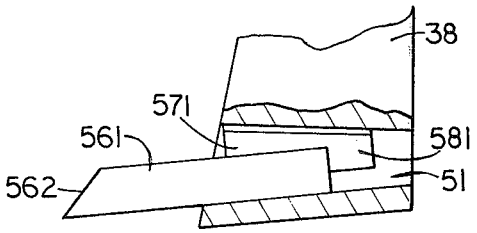
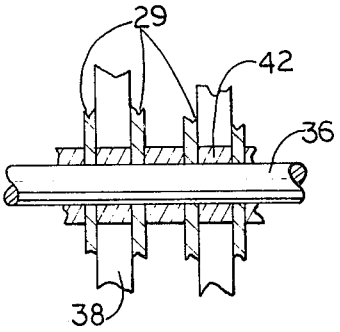
FIG. 6

PAVEMENT PLANING DEVICE

This invention relates to a machine for removing a portion of a hard brittle surface. More particularly, this invention relates to a machine for chipping away or planing a surface portion of a pavement or the like.

An object of this invention is to provide a pavement planing machine in which impact chipping hammer members chip or plane the surface of a pavement or the like.

A further object of this invention is to provide such a machine in which each hammer member, after making an impact, swings back and bounces against an anvil member to cause the hammer member to make additional impacts.

A further object of this invention is to provide such a device in which chisel tool elements are removably mounted in the hammer members so that the chisel tool elements can be changed as the chisel tool elements wear.

Briefly, this invention provides a pavement planing machine which includes a shaft on which a hammer support assembly or wheel is mounted. The hammer support assembly includes a plurality of spaced plates between which hammer members are pivotally mounted. Each hammer member carries a chisel tool element which is engageable with the pavement. Anvil members are mounted behind the hammer members, and each hammer member can swing back against an associated anvil member after a first impact against the pavement surface to rebound in a second or additional impacts. Forward swinging of the hammer members is limited so that each hammer member assumes a proper position before the chisel tool element carried by the hammer member is caused to make an impact upon the pavement.

The above and other objects and features of the invention will be apparent to those skilled in the art to which this invention pertains from the following detailed description and the drawings, in which:

FIG. 5 is a fragmentary view in section taken generally on the line 5—5 in FIG. 4;

FIG. 6 is a fragmentary view in section taken on the line 6—6 in FIG. 4; and

FIG. 7 is a fragmentary view partly in side elevation and partly in section of a cutter holder member and a sharpened tool.

In the following detailed description and the drawings, like reference characters indicate like parts.

Figure 2:
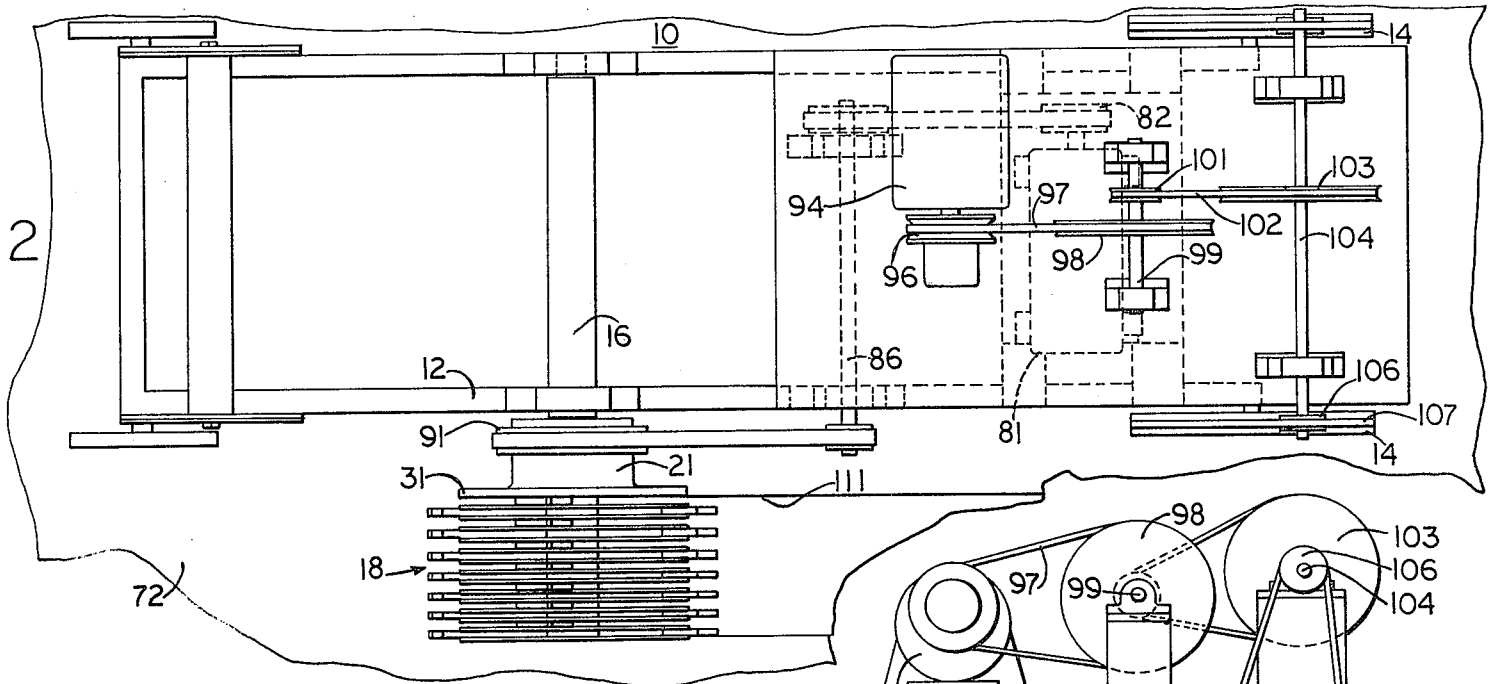
FIG. 2 is a top plan view thereof.
Figure 1:
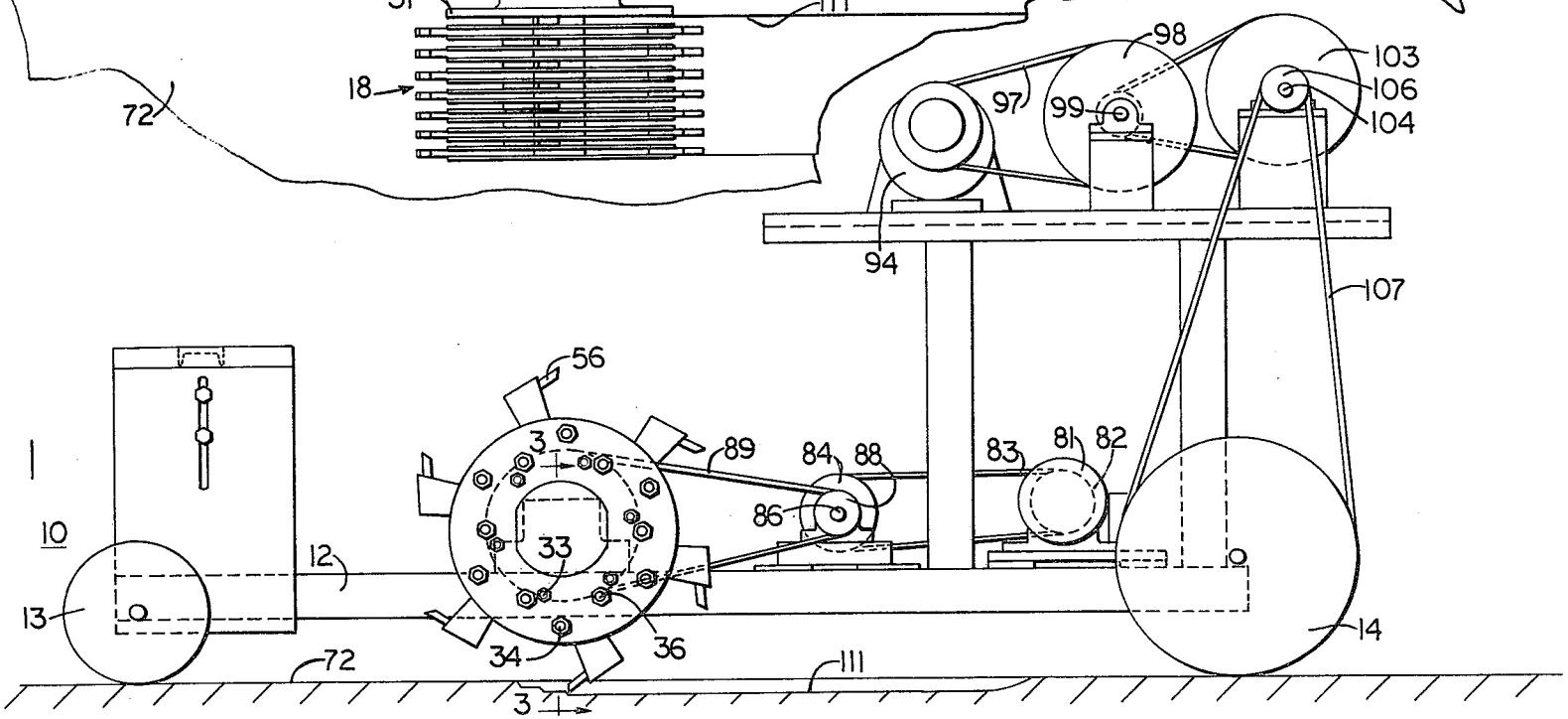
FIG. 1 is a view in side elevation of a planing machine constructed in accordance with an embodiment of this invention.

In FIGS. 1 and 2 is shown a pavement planing machine 10 constructed in accordance with an embodiment of this invention. The machine 10 includes a framework 12 supported on front wheels 13 and rear wheels 14. A cross shaft 16 is attached to the framework 12 with an end portion thereof extending cantilever fashion to one side of the framework 12.

Figure 3:
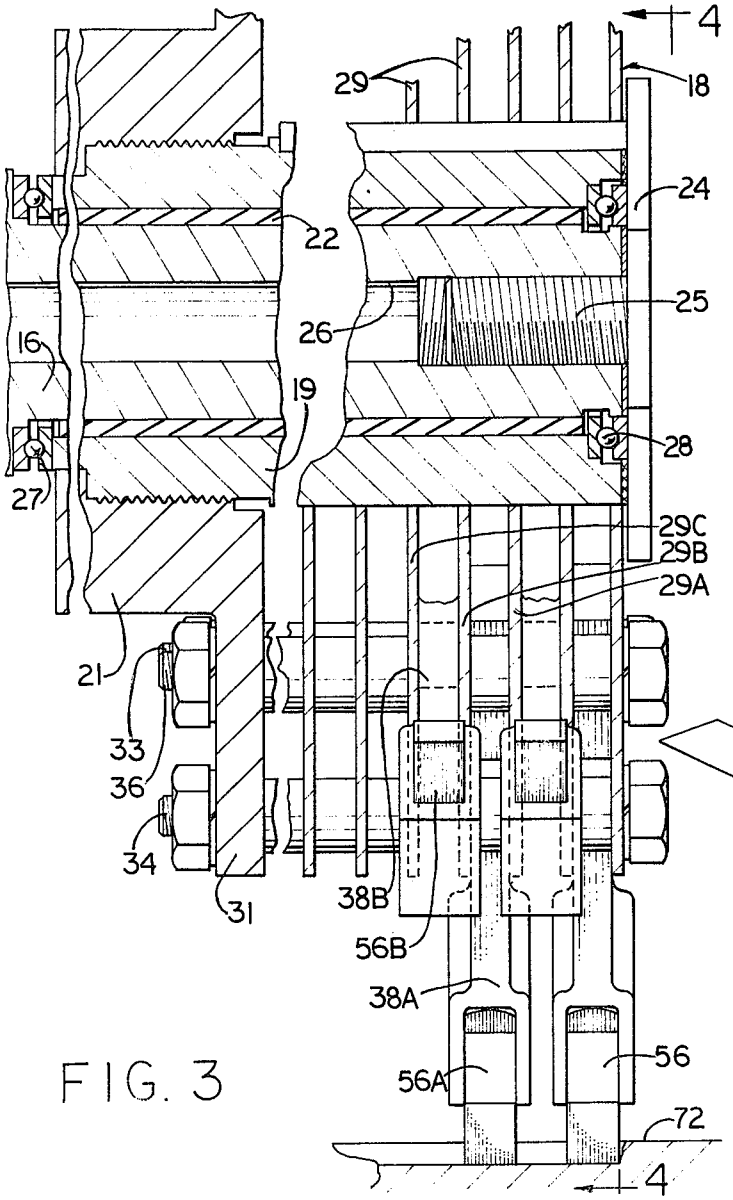
FIG. 3 is a view in section taken on an enlarged scale generally on the line 3—3 in FIG. 1.

A hammer support assembly or wheel 18 is rotatably mounted on the shaft 16 as shown in FIG. 3. The assembly 18 includes an inner tubular member 19 rotatably mounted on the shaft 16 and a flange member 21 threaded on the tubular member 19. A bearing sleeve 22 is provided between the shaft 16 and the tubular member 19. An end cap 24 having a bolt portion 25 threaded in a central bore 26 of the shaft 16 retains the assembly 18 and bearings 27 and 28 in position on the shaft 16.

A plurality of spacer plates 29 is mounted on the assembly 18 and keyed to the tubular member 19. The spacer plates 29 are connected together and to an annular flange 31 of the flange member 21 by pivot bolts 33, restraining stop supporting bolts 34, and retraction stop supporting bolts 36.

Figure 4:
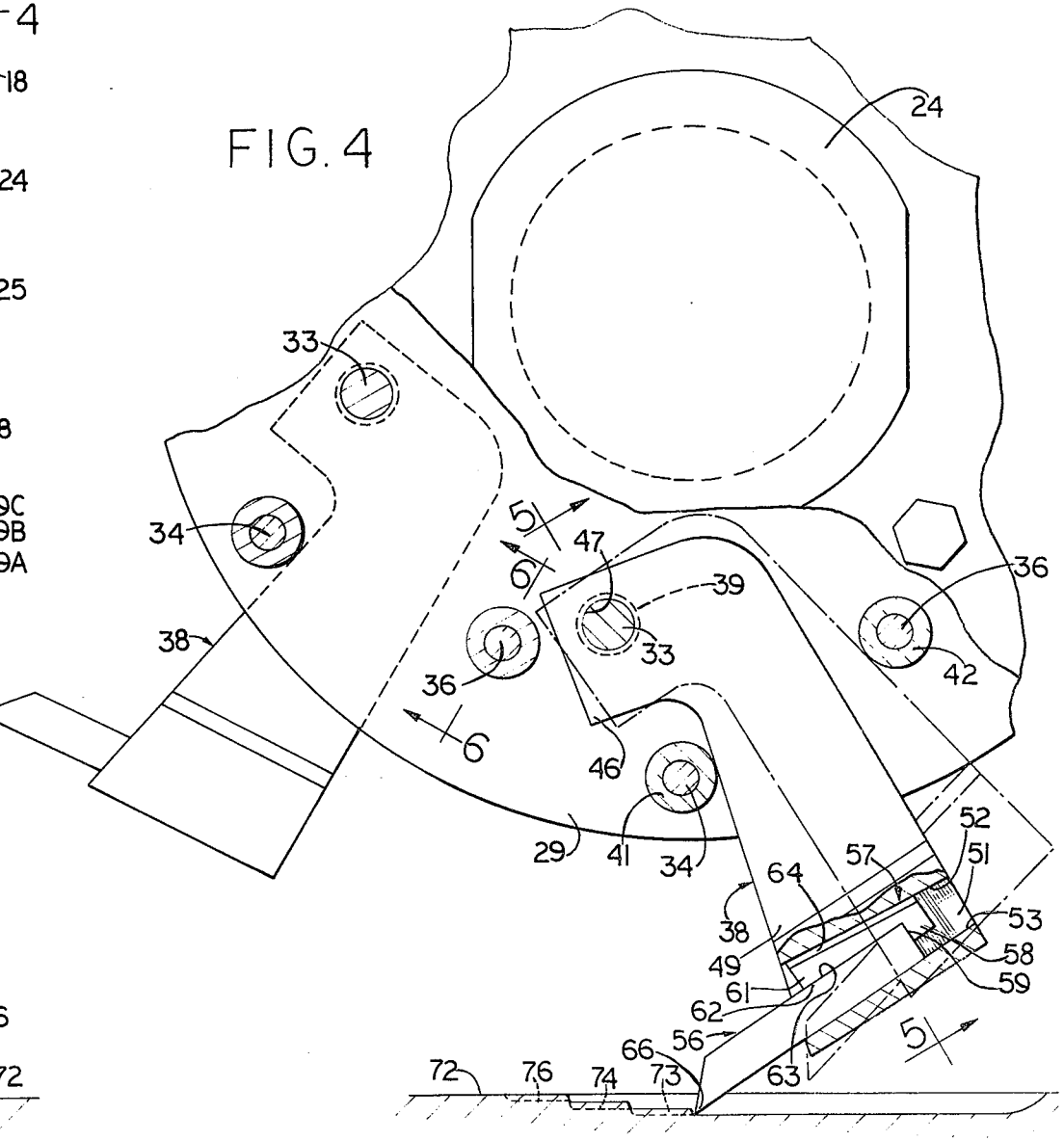
FIG. 4 is a view in section taken generally on the line 4—4 in FIG. 3, lines of cut being indicated in dashed lines, a retracted position of a cutter holder member and of a cutting tool being shown in dot-dash lines.

On each of the pivot bolts 33 is pivotally mounted a plurality of cutter holder members 38 (FIG. 4). In addition, a plurality of spacer sleeves 39 (FIGS. 4 and 5) is mounted on each of the pivot bolts 33. The cutter holder members 38 and the spacer sleeves 39 are mounted between adjacent plates 29, and the cutter holder members 38 and the spacer sleeves 39 alternate along each of the pivot bolts 33. On each of the restraining stop supporting bolts 34 is mounted a plurality of tubular restrainer stop members 41, each of which is positioned between adjacent plates 29. On each of the retraction stop supporting bolts 36 (FIG. 6) is mounted a plurality of tubular retraction stop members or rings 42, each of which is positioned between adjacent plates 29.

As shown in FIGS. 3 and 4, each of the cutter holder members 38 is of generally L-shape. Adjacent an end of a first arm 46 (FIG. 4) of the body 44 is a transverse bearing bore 47 in which an associated one of the pivot bolts 33 is received for pivotally supporting the member 38. At an outer end portion of a second arm 49 of the member 38 is a socket 51. As shown in FIG. 4, an upper wall 52 and a lower wall 53 of the socket 51 converge toward the right. A chisel-like cutting tool or bit 56 of rectangular cross-section is mounted in the socket 51. The tool 56 is held by an L-shaped tool-holding wedge member 57. The wedge member 57 includes a hook arm portion 58 which engages a rear wall 59 of the tool 56. A main arm 61 of the wedge member 57 includes a tool-engaging face 62, which fits in face-to-face relation to a face 63 of the tool 56 and a sloping, arched face 64, which is engaged by the upper socket wall 52. As shown in FIG. 5, the face 64 is convexly arched so that the face 64 engages the wall 52 along a line of contact. The tool 56 and the wedge member 57 form an assembly which is wedged in the socket 51 with a sharpened tip 66 of the tool 56 extending outwardly to one side of the holder member 38.

When the support assembly 18 (FIG. 3) and the plates 29 are rotated clockwise as shown in FIG. 4, each of the members 38 tends to swing outwardly to the extended position shown in full lines in which the member 38 engages an associated restrainer stop member 41. At this position, the sharpened tip 66 of the tool 56 is in position to engage a pavement 72 (FIG. 4) with an impact to make a first cut 73 in the pavement 72 indicated in dashed lines in FIG. 4. The member 34 bounces back against the associated retraction stop member 42 and rebounds to make a second cut 74. The holder member 38 and the tool 56 can rebound a second time to make a third cut 76 before the tool 56 swings free of the pavement 72.

The support assembly 18 (FIG. 3) and the plates 29 are rotated by a motor 81 (FIGS. 1 and 2) mounted on the framework 12. The motor 81 drives a pulley 82 on which a belt 83 runs. The belt 83 drives a pulley 84 mounted on a shaft 86. The shaft 86 is rotatably mounted on the framework 12. A pulley 88 mounted on the shaft 86 drives a belt 89 which runs on a pulley 91 (FIG. 2) mounted on the flange member 21 to drive the assembly 18.

The machine 10 is advanced along the pavement 72 by operation of a motor 94 mounted on the framework 12. The motor 94 drives a pulley 96 on which a belt 97 runs. The belt 97 drives a pulley 98 mounted on a shaft 99 which carries a pulley 101. The pulley 101 drives a belt 102 which runs on a pulley 103 mounted on a shaft 104. The shaft 104 carries pulleys 106 on which belts 107 run. The belts 107 drive the wheels 14 to cause the machine 10 to advance.

The assembly 18 can be rotated at a speed to cause the tools 56 to chip the surface of the pavement 72. For a machine in which the radial distance from the center of rotation of the assembly 18 to the tips 66 of the tools 56 in extended position is one foot, the rate of rotation can be approximately 180 revolutions per minute. The machine is advanced at a speed which permits clean chipping of the surface of the pavement. As shown in FIG. 3, tools 56A mounted on cutter holder members 38A mounted between plates 29A and 29B overlap tools 56B mounted on cutter holder members 38B mounted between the plates 29B and 29C so that a broad cut 111 (FIG. 2) is made in the surface of the pavement 72.

When one of the tools 56 has become worn, the tool 56 and the wedge 58 can be advanced to the left as shown in FIG. 4 to be released from the socket 51, and the tool 56 can be sharpened to form a sharpened tool 561 with a reformed face 562 as shown in FIG. 7. The sharpened tool 561 can be mounted in the socket 51 with a wedge 571 having a large hook arm portion 581 to accommodate the sharpened tool.

The position of the stops can be varied for cutting different types of material, such as portland concrete, bituminous asphalt, ores, stone, coal etc. The center distance between the pivot and the restraining stop, the angle of restraint of the cutter element, the distance of swing of the cutter element, the angle of the face of the chisel tool, the radial distance between the stops and the center of the wheel, the weight of the cutter element, and the peripheral speed can also be varied.

The machine has been described in particular with reference to planing of a pavement, but the machine can be used for other purposes, such as the mining of coal from a coal seam, and the machine illustrated in the drawings and described above is subject to structural modification without departing from the spirit and scope of the appended claims.

Having described my invention, what I claim as new and desire to secure by Letters Patent is:

1. A device for removing a part of a surface which comprises a wheel, means for rotating the wheel about a transverse axis, a cutter holder member pivotally mounted on the wheel, the axis of mounting of the cutter holder member being spaced from and parallel to the axis of rotation of the wheel, an elongated cutting tool mounted in a transverse opening in the cutter holder member with a head end portion of the tool extending outwardly of the transverse opening and projecting to one side of the cutter holder member, walls of the transverse opening converging, an L-shaped wedge member mounted in the transverse opening with faces of one arm of the wedge member engaging a face of the tool and one of the converging walls of the transverse opening in wedging relation and the other arm of the wedge member bearing on an end of the tool remote from the head end portion to hold the tool in the transverse opening, a restraining stop member mounted on the wheel and engageable by the cutter holder member as the cutter holder member swings outwardly as the wheel is rotated to position the cutter holder member with the tool in position to make an impact on the surface, and a retraction stop member mounted on the wheel and engageable by the cutter holder member as the cutter holder member swings backwardly following impact with the surface, the retraction stop member having line contact with the cutter holder member at the instants of contact and separation, the cutter holder member being arranged to rebound from the retraction stop member so that the tool makes a second impact on the surface.

2. A device as in claim 1 wherein the converging wall engaged by said one arm of the wedge member is flat and the face of the wedge member engaging the converging wall is convex lengthwise of the wedge member so that there is line contact between the wedge member and the converging wall engaged by the wedge member, an end of the transverse opening being open to expose the other arm of the wedge member.

* * * * *